United States Patent [19]

Adrian et al.

[11] Patent Number: 4,458,138

[45] Date of Patent: Jul. 3, 1984

[54] FAST RECOVERY ELECTRIC FLUID

[76] Inventors: Glenn J. Adrian; Harry W. Adrion; James W. Penner; all of Butterfield, Minn. 56120

[21] Appl. No.: 216,330

[22] Filed: Dec. 15, 1980

[51] Int. Cl.[3] ..... F24H 1/20; F28D 1/06; H05B 3/82

[52] U.S. Cl. ..... 219/304; 122/33; 165/104.19; 165/163; 219/302; 219/321; 219/326

[58] Field of Search ..... 219/302, 325, 326, 304, 219/310, 312, 314, 316, 320, 321, 303; 165/104.19, 163; 122/32, 33, 4 A, 13 A

[56] References Cited

U.S. PATENT DOCUMENTS

| | | | |
|---|---|---|---|
| 491,320 | 2/1893 | Mitchell . | |
| 884,540 | 4/1908 | Thomson | 219/326 X |
| 1,110,919 | 9/1914 | Gamble . | |
| 1,560,528 | 4/1924 | Baum . | |
| 1,595,819 | 8/1926 | Bluemlein . | |
| 1,607,393 | 11/1926 | Derby | 219/326 X |
| 1,622,951 | 3/1927 | Lewis . | |
| 2,048,104 | 7/1936 | Clinefelter . | |
| 2,384,704 | 9/1945 | Standing | 219/320 |
| 2,565,543 | 8/1951 | Arvintz et al. | 219/326 X |
| 2,748,249 | 3/1953 | Collerati . | |
| 2,791,204 | 5/1957 | Andrus | 122/33 |
| 3,256,708 | 6/1966 | Redfern | 219/326 X |
| 3,256,991 | 6/1966 | Kamrud | 219/326 X |

FOREIGN PATENT DOCUMENTS

| | | | |
|---|---|---|---|
| 204046 | 10/1956 | Australia | 219/326 |
| 1057312 | 5/1959 | Fed. Rep. of Germany | 219/314 |
| 1454680 | 2/1969 | Fed. Rep. of Germany | 219/326 |
| 2532377 | 2/1977 | Fed. Rep. of Germany | 219/321 |
| 943266 | 10/1948 | France | 219/326 |
| 2060383 | 6/1971 | France . | |
| 2287020 | 4/1976 | France | 219/326 |

*Primary Examiner*—Anthony Bartis

[57] ABSTRACT

A high efficiency fast recovery electric fluid heating system includes a closed elongated housing having thermostatically controlled high-wattage electric immersion heating elements extending from the housing ends into the interior thereof. The housing is adapted to be filled with fluid to be heated by the heating elements and has a fluid inlet at one end and a fluid outlet at the other. A helical tubular member extends within the housing from end to end thereof in coaxial spaced relationship to the heating elements and has its ends extending externally of the tank to provide inlet and outlet connections for supply of fluid thereto. An elongated open-ended tubular member is disposed within the helical tubular member and around the heating elements to define a confined fluid heating space within the housing. The elongated tubular member is provided with a plurality of elongated apertures midway along its length to allow circulation of highly heated fluid from the confined space into heat exchange relationship with the helical tubular member. In another embodiment, a second oppositely wound helical tubular member is disposed coaxially about the first helical tubular member and has fluid inlet and outlet ends extending externally of the housing. An additional helical tubular member may be wound about and in contact with the exterior of the housing and connected in series with a helical tubular member in the housing to capture heat radiating from the walls of the housing. The same or different fluids can be caused to flow through the housing and the helical tubular members for heating.

11 Claims, 4 Drawing Figures

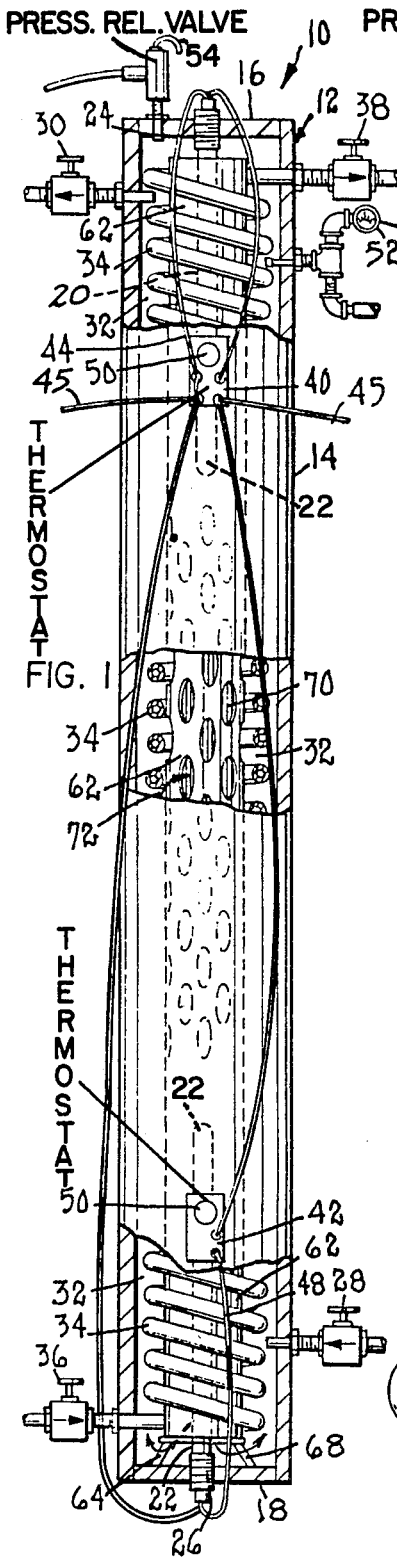
FIG. 1
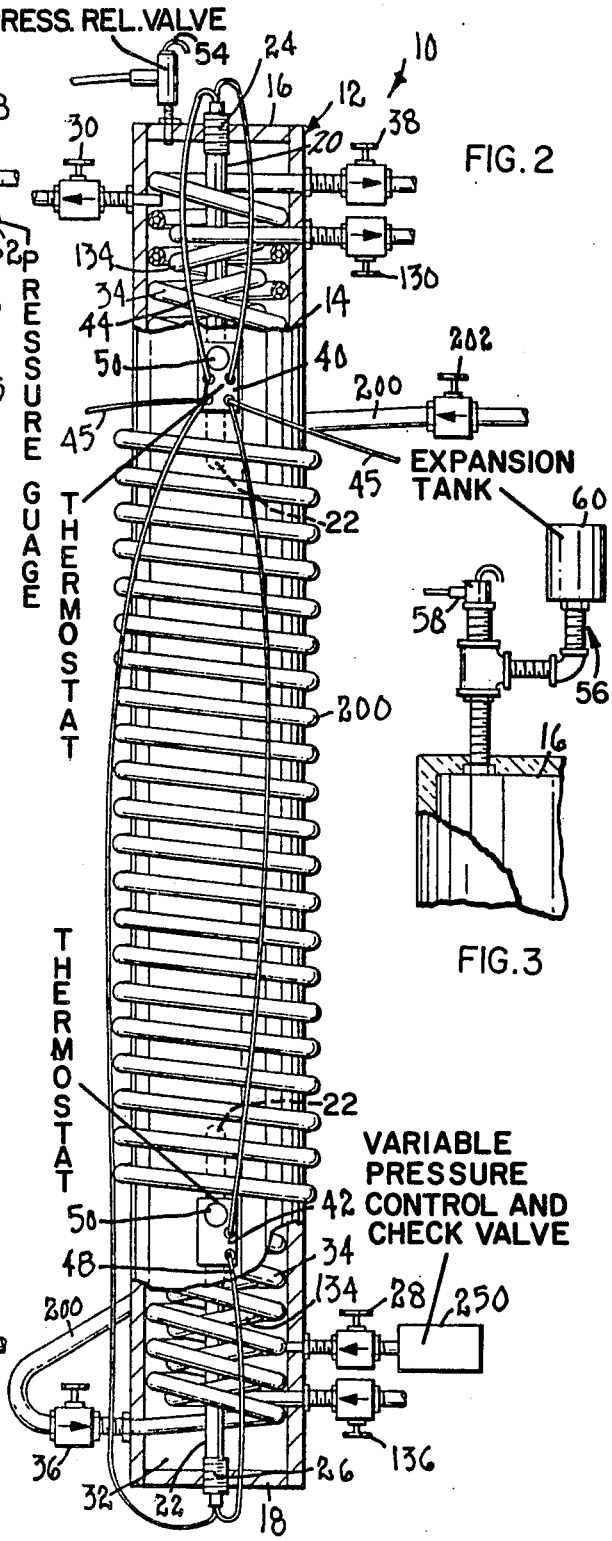
FIG. 2
FIG. 3

FAST RECOVERY ELECTRIC FLUID

TECHNICAL FIELD

The present invention relates to a high efficiency heater intended primarily for heating water.

BACKGROUND OF THE INVENTION

Traditionally fluids, particularly water, have been heated in large insulated tanks so as to provide a ready reservoir of heated water when needed. This system results in substantial energy loss due to the large amount of water which must be maintained at a constant high temperature for indefinite periods of time. To increase the efficiency of a fluid heating system, it is necessary to reduce the amount of fluid which must be maintained at a high temperature, provide a low-loss heat-transmissive substance to transfer heat energy from the heating source to the fluid to be heated.

The present invention provides for a heater capable of rapid and efficient heat transfer between a heating element and the fluid to be heated.

SUMMARY OF THE INVENTION

The present invention is a heating system which includes a closed elongated housing having first and second ends, first and second heating elements extending through the first and second ends, respectively, into the interior space defined by said housing, first inlet means in the housing located toward the first end for admitting fluid into the housing, and an outlet means in the tank located toward the second end for withdrawing fluid from the housing. Also included is a first helical tubular member extending within the housing and generally extending from the first end to the second end of the housing and having second means for admitting and withdrawing fluids from the helical tubular member through the housing.

According to a further aspect of the invention, there is included an elongated tubular member disposed in said housing and coaxially aligned therewith.

According to another aspect of the invention, there is included a second helical tubular member wound inside the first helical member.

BRIEF DESCRIPTION OF THE DRAWINGS

FIG. 1 is a transverse section with portions broken away of one embodiment of the present invention;

FIG. 2 is a transverse section with portions broken away of another embodiment of the present invention;

FIG. 3 is a partial fragmentary view of a portion of the housing shown in FIGS. 1 and 2 with an expansion tank system shown.

DETAILED DESCRIPTION OF THE INVENTION

Figure 4:
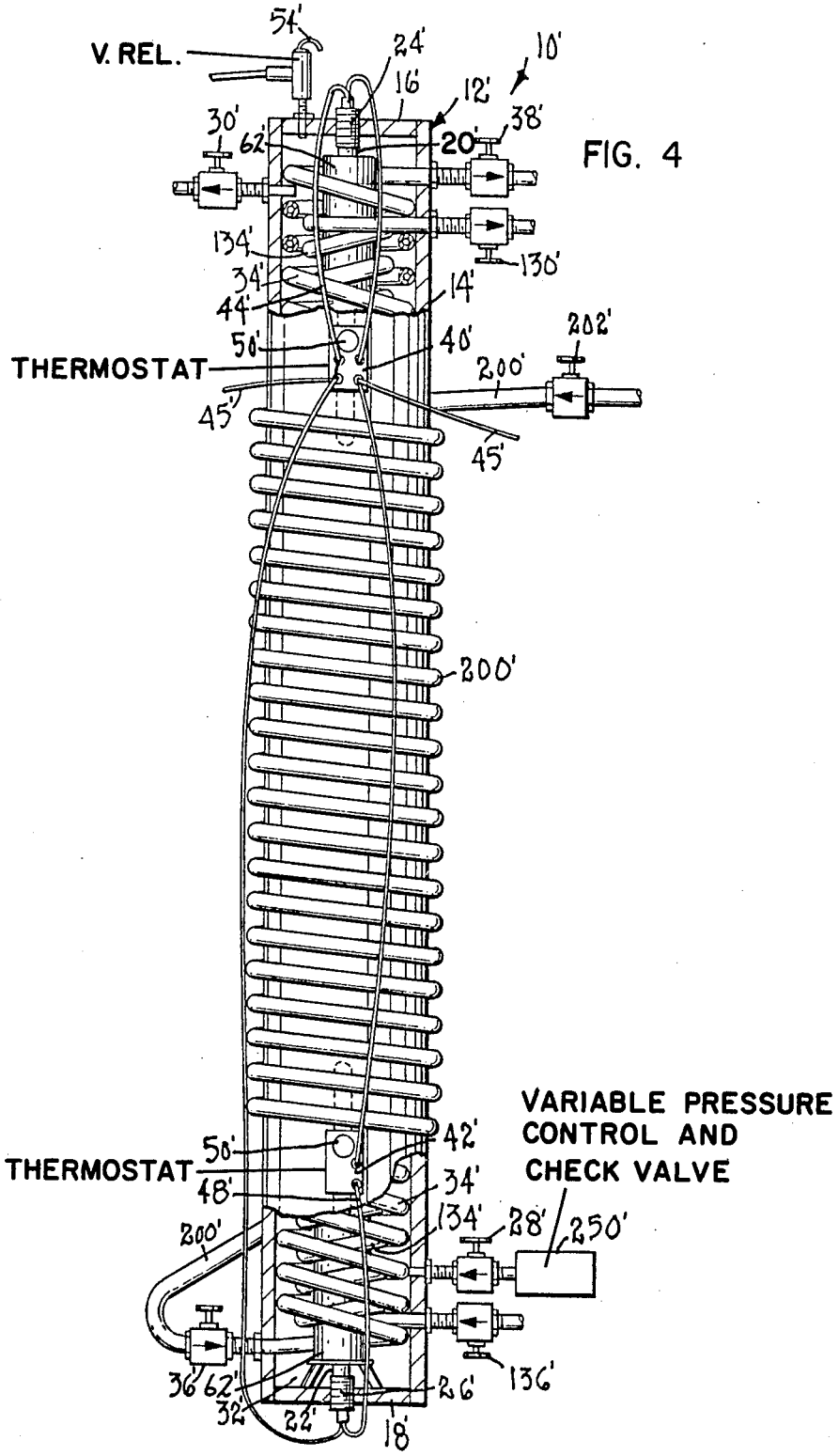
FIG. 4 is a transverse section with portions broken away of another embodiment of the present invention.

Referring to the drawings in detail, wherein like numerals represent like parts throughout the several views, a first embodiment of the fast recovery heater is shown in FIG. 1 and is designated generally by the numeral 10. Heater 10 in its basic form includes a housing 12 preferably capable of withstanding high internal pressures which is preferably an elongated cylindrical structure 14 having closed ends 16 and 18, a pair of heating elements 20 and 22 having threaded portions 24 and 26 designed to be received within apertures in ends

16 and 18 respectively. The heating elements are preferably electrically energized. Also included in housing 10 are inlet valve 28 and outlet valve 30 which are in fluid communication with the interior space 32 within housing 12. Extending generally from end 16 to end 18 is a helical tubular member 34 which has an inlet valve 36 and an outlet valve 38 attached thereto at its ends through housing 12 to permit the passage of fluid through the tubular member. Heating elements 20 and 22 are connected to thermostats 40 and 42 respectively by means of wires 44 and 48. Power is supplied to the elements by wires 45. Thermostats 40 and 42 each have a heat sensor 50 biased against the outside surface of housing 12. In the preferred embodiment the thermostats independently control heating elements 20 and 22 with thermostat 40 (the upper thermostat) being an override type capable of disconnecting power to element 22 if element 20 is energized. Such an override thermostat is a CHROMOLAX 5135 made by Thermodisk of Mansfield, Ohio. Alternatively, each thermostat may be the same with no override. Sensor 50 is designed to measure the surface temperature of the tube and activate and deactivate heating elements 20 and 22 at a predetermined fixed temperature. Two thermostats are preferred to more accurately measure the temperature at each element. Since the heat loss through the housing can be measured, a particular temperature at the outside surface will be in relative correspondence with the temperature within the interior space 32. The volume of the interior space within the housing is preferably selected so that a nearly instantaneous increase in fluid temperature is achieved and so that the system reaches equilibrium or thermostatic temperature very rapidly.

It is understood that in the preferred embodiment, cylindrical structure 14 has a relatively small diameter such that helical member 34 and heating elements 20 and 22 are preferably in very close proximity. The closer the dimensions, the greater efficiency is obtained.

Additional features may also be added to heater 10. A pressure gauge 52 is shown mounted in tubular member 12 for measuring the fluid pressure within interior space 32. A pressure relief valve 54 is shown in end member 16 and in fluid communication with interior space 32. Valve 54 is designed to permit expulsion of fluids within the interior space should the pressure within exceed a predetermined level.

As an alternative to a simple pressure relief valve such as 54, there is shown in FIG. 3 an expansion tank system mounted in end 16. The expansion tank system 56 includes a pressure relief valve 58 essentially the same as valve 54, and an expansion tank 60 hooked up in parallel with valve 58. Expansion tank 60 operates in a manner similar to that of hot water heating systems by creating a "air cushion" upon which fluid within space 32 may expand according to its temperature without causing valve 58 to open. This feature permits the interior space 32 to be completely filled with fluid for maximum heat transference while allowing necessary room for expansion of the heated fluid.

FIG. 1 also shows an additional elongated tubular member 62 within housing 10 which may be added for increased efficiency. Tubular member 62 is disposed within helical tubular member 34 with heating elements 20 and 22 disposed partially within tubular member 62. Member 62 is held in place at one end by three support members 64, two of which are attached to one end of the member and to end 18 of housing 12. The third support member is not visible as its view is blocked by element 22. Support members 64–68 are preferably attached to tubular member 62 at points equally spaced therearound so as to create a "tripod" support.

Generally midway along the length of tubular member 62 are located a plurality of holes 70 preferably elongated in shape. Holes 70 provide a passage for fluid circulation within interior space 32.

The effect of adding member 62 to heater 10 is to create a "superheating" arrangement which should cause the fluid in space 32 to become more quickly and more evenly heated. Fluid in contact with heating elements 20 and 22 will become heated very quickly because of the small confined space thus created causing currents to flow around the ends of member 62 and through holes 70 as shown by arrows 72.

It is also possible to affix member 62 at its remaining end with a like tripod support arrangement.

With valves 28, 30, 36, and 38, it is possible to heat a fluid in a number of different ways. One possibility is to fill the interior space 32 with a fluid, such as water, via valve 28 and to run a second fluid through valve 36 into helical member 34 and out valve 38. The result is that fluid within member 34 will become heated primarily as a result of the transmissive effect of the fluid within space 32. It is also possible to run a fluid through valve 28 and out valve 30 or finally, to pass a fluid through both inlet valves to obtain two separate sources of heated fluid. It is understood that the fluids need not be of the same nature and therefore an advantage results in that incompatible fluids may be heated by a single system without mixing.

SECOND EMBODIMENT

FIG. 2 of the drawings illustrates a second embodiment of the present invention. Those parts and features of the first embodiment which are identical in the second embodiment will carry the same numeral and their function or operation will not be reiterated.

Aside from the elements shown in the first embodiment, this second embodiment may contain the following additional elements. Included within housing 12 is a second helical tubular member 134 which is shown disposed within tubular member 34 and extending generally from end 16 to end 18. It is preferable to have members 34 and 134 wound in opposite directions (clockwise and counterclockwise) so that the maximum surface area comes in contact with fluid which is maintained within interior space 32. Like tubular member 34, the second tubular member 134 includes an inlet valve 136 and an outlet valve 138 for admitting and withdrawing fluid from member 134 through housing 12. As in the first embodiment, it is possible to run different fluids through members 134 and 34 in addition to a fluid which fills the interior space through valves 28 and 30.

As an additonal means of increasing efficiency, an extra outer tubular member 200 may be included as shown in FIG. 2. Member 200 is a helical tubular member wound around the outside surface of housing 12 and preferably in contact therewith. Member 200 is shown having an inlet valve 202 and is shown terminating at inlet valve 36 which is the inlet to tubular member 34. Thus it can be seen that member 200 and member 34 are attached in series so that fluid passing through member 200 will capture any heat which radiates through housing 12 prior to entering the interior space 32. Member 200 thus improves the efficiency of the heating system by acting as a heat recovery device.

Box 250, which is in fluid communication with valve 28, is shown to indicate a variable pressure control valve for maintaining the pressure within the interior space and check valve to prevent bleedback of fluid out of the valve 28. These additional features may also be applied to the embodiment shown in FIG. 1. Although not shown, both embodiments may preferably include a heat insulating outer covering to be applied over housing 12 and tubular member 200 (in the case of the second embodiment) so as to further reduce heat loss.

It should be understood that tubular member 200 and associated valve 202 may also be included in the first embodiment as shown in FIG. 1. Likewise, the tubular member 62 which is disposed within the interior space 32 in FIG. 1 may also be included in the second embodiment. FIG. 4 of the drawings shows such an embodiment with a "prime" marking added.

The expansion tank system 56 shown in FIG. 3 is also applicable to the second embodiment shown in FIG. 2 by replacing valve 54 therewith. Gauge 52 is not shown in FIG. 2; however, it is understood that it may be added in a likewise fashion.

In the preferred embodiment, it is anticipated that the flow rate of fluid through member 34 or member 134 would be approximately 11.5 liters per minute (3 gallons per minute). The housing 12 would have a 15 centimeter (6 inch) outside diameter with 12 millimeter (½ inch) thick walls and be made of steel pipe. Top and bottom members 16 and 18 would be welded in place. Pressure relief valve 54 would be set at 0.022 $Nt/m^2$ (150 psi). Heating elements 20 and 22 are preferably 4500 watt elements. With the above flow rate, member 34 will carry roughly the volume of water within the interior space every minute. The heater may be operated in either a vertical or a horizontal orientation.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent of the broad general meaning of the terms in which the appended claims are expressed.

What is claimed is:

1. A fast recovery water heating system comprising a closed elongated housing defining an interior space, said interior space being capable of being entirely filled with water and said housing being capable of withstanding high internal pressure, said housing including:

first and second ends, first and second elongated electrical heating elements extending into said interior space through said first and second ends respectively, said elements being coaxially aligned with said housing, admitting means in said housing located toward one of said ends for injecting water into said space, withdrawing means in said housing located toward the other of said ends distant from said admitting means for permitting withdrawal of water from said space, a first helical tubular member disposed coaxially around said elements and generally extending from said first to said second end, inlet and outlet means connected to ends of said helical member for permitting and controlling the passage of water through said member, an open-ended elongated tubular member disposed coaxially with respect to said heating elements and within said helical tubular member, said elongated tubular member including a plurality of apertures therein located generally midway along the length thereof to allow the water filling the interior of the elongated tubular member and highly heated by said heating elements to flow out of the elongated tubular member into contact with the helical tubular member, first and second thermostatic means affixed to said housing proximate said first and second elements respectively for controlling the flow of electricity to said heating elements to maintain a relatively constant predetermined temperature within said interior space, the volume of said interior space and the heat output of said heating elements being selected so that a nearly instantaneous increase in water temperature is achieved when said heating elements are energized.

2. A heating system comprising a closed elongated housing having first and second ends, first and second heating elements extending through said first and second ends, respectively, into the interior space defined by said housing, first inlet means in said housing located toward said first end for admitting fluid into said housing, outlet means in said housing located toward said second end for withdrawing fluid from said housing, a first helical tubular member extending within said housing and generally extending from said first end to said second end of said housing and having second means located near each of said ends for admitting and withdrawing fluids in said first helical tubular member from outside of said housing, an elongated open-ended tubular member disposed within said helical tubular member and coaxially with respect to said heating elements substantially covering said heating elements, said tubular member including a plurality of apertures generally midway along the length thereof to provide fluid circulation between the ends and apertures of the tubular member thereby transferring heat to said helical tubular member, said housing having an interior volume and the heating elements having a heat output selected such that a nearly instantaneous increase in fluid temperature is achieved when said heating elements are energized.

3. A heating system according to claim 2 wherein said apertures are slot shaped.

4. A heating system according to claim 3 wherein said elongated tubular member includes a plurality of support members extending from one end of said tubular member to said first end of said housing.

5. A heating system according to claim 4 wherein said support members include three supports affixed to said tubular member at points equally spaced.

6. A heating system according to claim 2 including a second helical tubular member wound over said first helical member in a direction opposite thereto.

7. A heating system according to claim 6 wherein said first and second helical members are disposed substantially within said elongated housing and coaxially aligned therewith.

8. A heating system according to claim 2 or 6 including an outer helical tubular member wound around and in contact with the outside surface of said housing and connected in series with said first helical tubular member so that heat emanating through said housing may be captured by said outer member.

9. A heating system according to claim 2 or 6 including thermostatic control unit responsive to the temperature of fluid in the interior of the housing unit connected to said heating elements for maintaining a fixed temperature within said interior space.

10. A heating system according to claim 9 wherein said control unit includes means for sensing the temperature within said interior space and means responsive to said sensing means for controlling energy flow to said heating elements.

11. A heating system according to claim 9 wherein said thermostat control unit includes two thermostats, one connected to each of said heating elements.

* * * * *

UNITED STATES PATENT AND TRADEMARK OFFICE

CERTIFICATE OF CORRECTION

PATENT NO. : 4,458,138

DATED : 3 July 1984

INVENTOR(S) : Glenn J. Adrian, et al.

It is certified that error appears in the above-identified patent and that said Letters Patent is hereby corrected as shown below:

On the face of the patent, the title should be:

--[54] FAST RECOVERY ELECTRIC FLUID HEATING SYSTEM--.

Also on the face of the patent, the inventors should be:

--[76] Inventors: Glenn J. Adrian; Harry W. Adrian; James W. Penner --.

Column 3, line 58, "additonal" should be --additional--.

Signed and Sealed this

*Eighteenth* Day of *December 1984*

[SEAL]

*Attest:*

*Attesting Officer*

GERALD J. MOSSINGHOFF

*Commissioner of Patents and Trademarks*